US006874777B2

(12) United States Patent
Sano et al.

(10) Patent No.: US 6,874,777 B2
(45) Date of Patent: Apr. 5, 2005

(54) SHEET FEED APPARATUS, SHEET SEPARATING MEMBER, SHEET FEED ASSEMBLY AND SHEET SEPARATING ASSEMBLY

(75) Inventors: Koichi Sano, Sagamihara (JP); Kenichi Kobayashi, Mishima (JP); Akira Yuza, Numazu (JP); Katsuhiko Nishimura, Yokohama (JP)

(73) Assignee: 3M Innovative Properties Company, St. Paul, MN (US)

( * ) Notice: Subject to any disclaimer, the term of this patent is extended or adjusted under 35 U.S.C. 154(b) by 175 days.

(21) Appl. No.: 10/397,113

(22) Filed: Mar. 26, 2003

(65) Prior Publication Data

US 2003/0222394 A1 Dec. 4, 2003

(30) Foreign Application Priority Data

Apr. 8, 2002 (JP) ..... 2002-105458

(51) Int. Cl.[7] ..... B65H 3/06
(52) U.S. Cl. ..... 271/109; 492/29
(58) Field of Search ..... 271/109; 492/29

(56) References Cited

U.S. PATENT DOCUMENTS 5,077,870 A 1/1992 Melbye et al.
5,908,680 A 6/1999 Moren et al.
6,059,281 A * 5/2000 Nakamura et al. ..... 271/119
6,106,922 A 8/2000 Cejka et al.
6,372,323 B1 4/2002 Kobe et al.
2001/0041652 A1 * 11/2001 Tsukada et al. ..... 492/30
2002/0114920 A1 8/2002 Scholz et al.
2004/0026844 A1 * 2/2004 Toriumi et al. ..... 271/109

FOREIGN PATENT DOCUMENTS

WO WO 02/13638 A2 2/2002

OTHER PUBLICATIONS

Working with Flexo, Mueller and MacAdam, Apr. 1989, American Ink Maker vol. 67 No. 4, pp28, 30,32, and 34–35.*

* cited by examiner

*Primary Examiner*—Donald P. Walsh
*Assistant Examiner*—Kenneth Bower

(57) ABSTRACT

A sheet feed roller 10 includes a shaft member 12 and an elastomeric layer 14 provided on the outer circumference of the shaft member 12. The shaft member 12 includes a tubular support 16 and a pair of shaft sections 18 extending in the axial direction to define a rotary axis of the shaft member 12. The elastomeric layer 14 is formed of an elastic member separate from the shaft member 12, and attached to the outer circumference 16*a* to be conformed with the profile of the support 16 of the shaft member 12. The elastomeric layer 14 includes a base 20 and a plurality of micro-structured elements 22, each having a three-dimensionally projected shape, formed on the surface 20*a* of the base 20. Each of the plurality of micro-structured elements 22 on the elastomeric layer 14 is brought into frictional contact at a distal end thereof with the sheet medium and feed the same as the shaft member rotates.

22 Claims, 15 Drawing Sheets

SHEET FEED APPARATUS, SHEET SEPARATING MEMBER, SHEET FEED ASSEMBLY AND SHEET SEPARATING ASSEMBLY

This application claims priority from Japanese Serial No. 2002-105458, filed Apr. 8, 2002.

The present invention relates to a sheet feed apparatus for feeding a sheet material. Also, the present invention relates to a sheet separating member for separating a plurality of sheets from each other, which are fed in an overlapped state in an optional direction. Further, the present invention relates to a sheet feed assembly and a sheet separating assembly, each of which includes at least one of the sheet feed apparatus and the sheet separating member.

BACKGROUND

A sheet feed assembly has been widely used in various image-forming apparatuses such as an electronic photocopier, a printer, a facsimile receiver or others in the prior art, in which a sheet material, such as a new printing sheet (used, e.g., for a copy), a used or printed paper, or a transparent sheet, is gripped between a rotatable feed roller and a sheet support plate disposed opposite to the outer circumference of the feed roller and elastically biased toward the feed roller and fed at a desired speed in an optional direction.

FIG. 14 illustrates one of the prior art sheet feed devices used in a sheet delivery part of an image-forming apparatus of such a kind, wherein FIG. 14(*a*) shows a state in which no printing sheet (or transfer medium) is stocked in a paper delivery part and FIG. 14(*b*) shows a state in which the printing sheet are stocked therein. This sheet feed device is provided with a feed roller (or a sheet feed apparatus) 1, a sheet delivery cassette 2, a sheet support base 3, a presser spring 4, a separating member 5, a final sheet separating plate 6, a sheet detecting arm 7 and a photo-interruptor 8.

In the state shown in FIG. 14(*b*) wherein the sheets are stocked, a group of the printing sheets stacked on the sheet support base 3 in the sheet delivery cassette 2 are pressed onto the outer circumference of the feed roller 1 under the elastic bias of the presser spring 4. Also, the sheet detecting arm 7 is brought into contact at a free end thereof with the uppermost printing sheet on the sheet support base 3 and lifted up to intercept a light path of the photo-interruptor 8. Thereby, the photo-interruptor 8 detects that the printing sheet is in the sheet delivery cassette 2.

During the sheet feed operation, the feed roller 1 rotates counter-clockwise in the drawing, picks up the uppermost sheet on the sheet support base 3 one by one from the group of printing sheets pressed onto the feed roller 1, and conveys the same in the right direction in the drawing. If two or more printing sheets are picked up together from the upper group of the printing sheets, the separating member 5 disposed downstream from a nip point between the feed roller 1 and the sheet support base 3 is frictionally engaged with the lower side of the plurality of printing sheets picked up together to brake the conveyance of the lower side sheet. As a result, the printing sheets are conveyed one by one. In this regard, it has also been known that a retard roller rotating opposite to the conveying direction may be provided downstream from the feed roller 1.

In the above arrangement, a frictional feeding mechanism and a frictional separation mechanism, each having a rubber surface (or a frictional surface), are generally used in the feed roller 1 and the separating member 5, respectively. In this case, for example, the friction coefficient between the printing sheets (or transfer media) is in a range from 0.4 to 0.7, the friction coefficient between the surface of the separating member 5 and the printing sheet is selected in a range from 0.9 to 1.1, and that between the outer circumference of the feed roller 1 and the printing sheet is 1.5 or more.

FIG. 15 schematically illustrates one prior art laser printer in which the above-mentioned sheet feed device is provided in the sheet delivery part thereof. The operation of this laser printer will be briefly explained below.

During the printing operation, the intensity of a laser beam generated from a laser scanner A is modulated based on image signals fed from a host computer (not shown), and an electrostatic latent image is formed on a photosensitive drum B. On the other hand, the printing sheet in the sheet delivery cassette 2 is picked up one by one by the feed roller 1 as described above, and then conveyed by a conveyor roller C toward the photosensitive drum B while the write timing is adjusted by a register roller D. Then, a toner image on the photosensitive drum B is transferred to the printing sheet by a transfer roller E. Thereafter, the printing sheet passes a conveyor belt F and a fixing roller G to fix the toner image on the printing sheet as a permanent fixed image, and is finally discharged via a discharge roller H and stacked on a tray I.

The above-mentioned prior art sheet feed device has the following problems.

First, when a thick sheet having a basis weight of about 200 g/m$^2$ is fed, a large delivery force is necessary which in turn requires a large capacity drive motor for the feed roller, as well as the friction to the separating member becomes excessive to be apt to generate noise called "squeak". Also, after the feeding force has been determined to properly feed such a thick sheet having a basis weight of about 200 g/m$^2$, if one wishes to feed a thin sheet having a basis weight of about 60 g/m$^2$, a plurality of thin sheets may be simultaneously fed together to generate a phenomenon called "multi-feed", which are difficult to be separated even by the separating member.

In addition, since the rubber-like material forming the surface of the feed roller or the separating member is softened or hardened due to the environmental fluctuation, or worn while being used for a long period, there may be a risk in that the friction coefficient thereof varies to deteriorate the sheet feeding performance. Also, it is necessary to use a drive source for the feed roller designed to have a sufficient margin relative to a necessary torque by taking the deterioration with time or the application to a thicker sheet into account.

SUMMARY OF THE INVENTION

An object of the present invention is to provide a sheet feed apparatus comprising, e.g., a sheet feed roller for feeding a sheet material in an optional direction, capable of maintaining a favorable feeding performance for a long period irrespective of a thickness (or a basis weight) of the sheet or a type of the sheet (e.g., an OHT or a glossy paper).

Another object of the present invention is to provide a sheet separating member for separating a plurality of sheets from each other, which are fed in an overlapped state in an optional direction, capable of maintaining a favorable feeding performance for a long period irrespective of a thickness (or a basis weight) of the sheet or a type of the sheet (e.g., an OHT or a glossy paper).

A further object of the invention is to provide a sheet feed assembly and a sheet separating assembly, each of which includes at least one of the sheet feed apparatus and the sheet separating member.

To achieve the above objects, the invention provides a sheet feed apparatus with an elastomeric layer formed on a surface of a non-cylindrical support body which is rotatable about a rotary axis, characterized in that the surface of the support body includes a main area arcuately extending over a desired center angle about the rotary axis and at least one auxiliary area extending inside an imaginary cylindrical surface containing the main area to be joined to the main area; the elastomeric layer comprises a base and a plurality of micro-structured elements formed on a surface of the base, each micro-structured element having a three-dimensionally projecting shape and being formed integrally with the base with a mutually identical elastic material; and that each micro-structured element is adapted to come into frictional contact at a distal end thereof with a sheet material to feed the sheet material by a rotation of the support body about the rotary axis.

The invention provides a sheet feed apparatus, wherein the plurality of micro-structured elements are provided on the surface of the support body in a spatial arrangement density of at least 15.5 stems/cm$^2$; and wherein the each micro-structured element has a height H of 0.254 mm to 1.27 mm as well as a maximum transverse dimension D of 0.076 mm to 0.76 mm under an aspect ratio $H/D \geqq 1.25$.

The invention provides a sheet feed apparatus wherein each of the plurality of micro-structured elements includes a columnar or pyramidal stem and a spherical, hemispherical or disk-like head integrally formed at a distal end of the stem.

The invention provides a sheet feed apparatus wherein the support body includes a tubular support having an outer circumference defining the surface of the support body and a shaft section extending axially from the tubular support to define the rotary axis; and wherein the elastomeric layer is formed of an elastic member fitted to the outer circumference of the tubular support in such a manner as to conform with a profile of the outer circumference.

The invention provides a sheet feed apparatus wherein the elastic member is provided with the plurality of micro-structured elements at least at a position corresponding to the main area of the surface of the support body.

The invention provides a sheet feed apparatus wherein the elastic member is of a plate-like member adhered to the outer circumference of the tubular support through an adhesive layer; and wherein a marginal edge of the elastic member is located at a position corresponding to the at least one auxiliary area of the surface of the support body.

The invention provides a sheet feed apparatus wherein the elastic member is of a seamless hollow cylindrical member fixedly attached to the outer circumference of the tubular support by a friction force and an elastic recovery force of the elastic member.

The invention provides a sheet separating assembly comprising a sheet feed roller with an elastomeric layer formed on an outer circumference of a shaft member, and a sheet separating member, characterized in that the sheet separating member has an elastomeric layer formed on a surface of a supporting body; each of the elastomeric layer of the sheet feed roller and the elastomeric layer of the sheet separating member comprises a base and a plurality of micro-structured elements formed on a surface of the base, each micro-structured element having a three-dimensionally projecting shape and being formed integrally with the base with a mutually identical elastic material; each micro-structured element of the elastomeric layer on the outer circumference of the shaft member is adapted to come into frictional contact at a distal end thereof with a sheet material to feed the sheet material in a desired direction by a rotation of the shaft member; and that each micro-structured element of the elastomeric layer on the surface of the supporting body is adapted to come into frictional contact at a distal end thereof with a sheet material moving in the desired direction to brake the movement of the sheet material.

The invention provides a sheet separating member with an elastomeric layer formed on a surface of a supporting body, characterized in that the elastomeric layer comprises a base and a plurality of micro-structured elements formed on a surface of the base, each micro-structured element having a three-dimensionally projecting shape and being formed integrally with the base with a mutually identical elastic material; and that each micro-structured element is adapted to come into frictional contact at a distal end thereof with a sheet material moving in a desired direction relative to the elastomeric layer to brake the sheet material.

The invention provides a sheet separating member, wherein the plurality of micro-structured elements are provided on the surface of the base in a spatial arrangement density of at least 15.5 stems/cm$^2$, and wherein the each micro-structured element has a height H of 0.254 mm to 1.27 mm as well as a maximum transverse dimension D of 0.076 mm to 0.76 mm under an aspect ratio $H/D \geqq 1.25$.

The invention provides a sheet separating member, wherein each of micro-structured elements includes a columnar or pyramidal stem and a spherical, hemispherical or disk-like head integrally formed at a distal end of the stem.

The invention provides a sheet separating member, wherein each micro-structured element has a cylindrical or truncated-conical shape.

The invention provides a sheet feed apparatus adapted to cooperate with a sheet separating member to feed a plurality of sheet materials in a one-by-one separated manner, characterized in that the apparatus comprises an elastomeric layer performing a sheet feeding motion; the elastomeric layer comprises a base and a plurality of micro-structured elements formed on a surface of the base, each micro-structured element having a three-dimensionally projecting shape and being formed integrally with the base with a mutually identical elastic material; and that each micro-structured element is adapted to come into frictional contact at a distal end thereof with a sheet material to feed the sheet material by the sheet feeding motion.

The invention provides a sheet feed apparatus, wherein the plurality of micro-structured elements are provided on the surface of the base in a spatial arrangement density of at least 15.5 stems/cm$^2$; and wherein the each micro-structured element has a height H of 0.254 mm to 1.27 mm as well as a maximum transverse dimension D of 0.076 mm to 0.76 mm under an aspect ratio $H/D \geqq 1.25$.

The invention provides a sheet feed apparatus, wherein each micro-structured element has a cylindrical or truncated-conical shape.

The invention provides a sheet feed apparatus, wherein each micro-structured element includes a columnar or pyramidal stem and a spherical, hemispherical or disk-like head integrally formed at a distal end of the stem.

The invention provides a sheet feed apparatus, further comprising a shaft member rotatable about a rotary axis, the elastomeric layer being formed on an outer circumference of the shaft member; wherein the shaft member includes a tubular support having the outer circumference and a shaft section extending axially from the tubular support to define the rotary axis; and wherein the elastomeric layer is formed of an elastic member fitted to the outer circumference of the tubular support in such a manner as to conform with a profile of the outer circumference.

The invention provides a sheet feed apparatus, wherein the outer circumference of the tubular support includes a main area arcuately extending over a desired center angle about the rotary axis and at least one auxiliary area extending inside an imaginary cylindrical surface containing the main area to be joined to the main area; and wherein the elastic member is provided with the plurality of micro-structured elements at least at a position corresponding to the main area of the outer circumference of the tubular support.

The invention provides a sheet feed apparatus, wherein the elastic member is of a plate-like member adhered to the outer circumference of the tubular support through an adhesive layer; and wherein a marginal edge of the elastic member is located at a position corresponding to the at least one auxiliary area of the outer circumference.

The invention provides a sheet feed apparatus, wherein the elastic member is of a seamless hollow cylindrical member fixedly attached to the outer circumference of the tubular support by a friction force and an elastic recovery force of the elastic member.

The invention provides a sheet feed assembly comprising a sheet support base and a sheet feed apparatus for feeding a plurality of sheet materials stacked on the sheet support base, characterized in that the sheet feed apparatus comprises a sheet feed apparatus as defined above.

The invention provides a sheet feed assembly comprising a sheet support base, a sheet feed apparatus for feeding a plurality of sheet materials stacked on the sheet support base, and a sheet separating member for cooperating with the sheet feed apparatus to feed the sheet materials in a one-by-one separated manner, characterized in that the sheet separating member comprises a sheet separating member as defined above.

BRIEF DESCRIPTION OF THE DRAWINGS

The preferred embodiments of the present invention will be described below in detail with reference to the attached drawings, wherein common reference numerals are used throughout all the drawings for denoting constituent elements corresponding to each other.

DETAILED DESCRIPTION

Figure 1A:
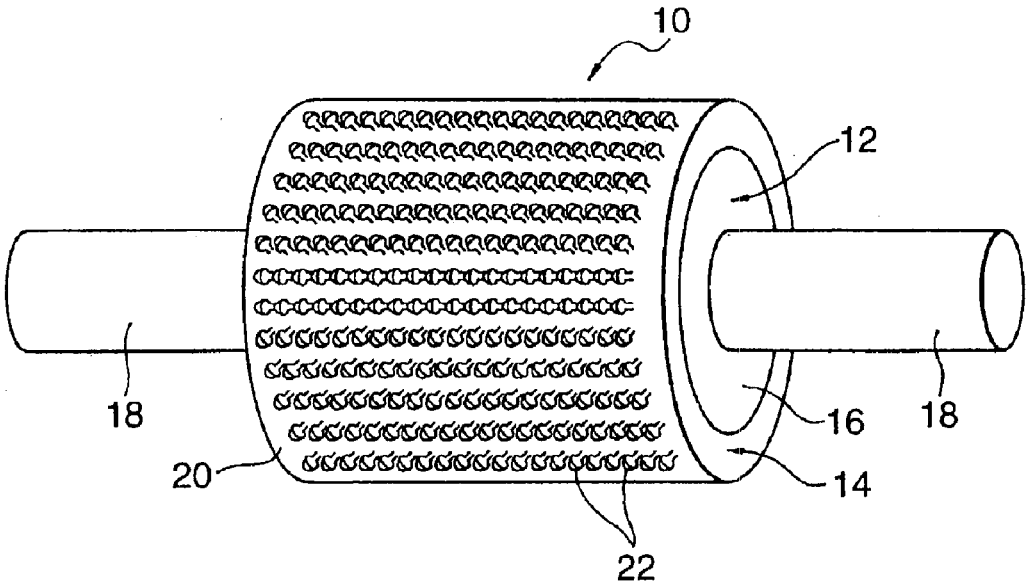
FIG. 1 is an illustration of a first embodiment of a sheet feed apparatus according to the present invention wherein FIG. 1(*a*) is a perspective view and FIG. 1(*b*) is an axial end view.
Figure 1B:
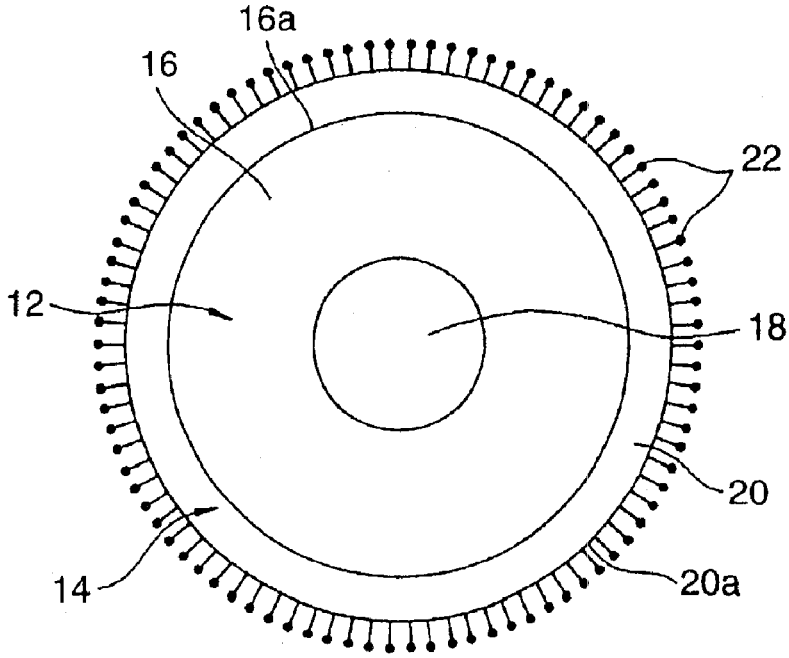

FIG. 1 illustrates a sheet feed apparatus 10 according to a first embodiment of the present invention. The sheet feed apparatus 10 includes a shaft member 12 and an elastomeric layer 14 provided on the outer circumference of the shaft member 12. The shaft member 12 includes a tubular support 16 having a cylindrical outer circumference 16*a* and a pair of shaft sections 18 integral with the support and extending from opposite axial ends of the support 16 in the axial direction to define a rotary axis 12*a* of the shaft member 12. The elastomeric layer 14 is formed of an elastic member separate from the shaft member 12, and attached to the outer circumference 16*a* to be conformed with the profile of the support 16 of the shaft member 12. As illustrated, the sheet feed apparatus 10 has a configuration of a sheet feed roller, and thus is hereinafter referred to as a sheet feed roller 10.

Figure 2:
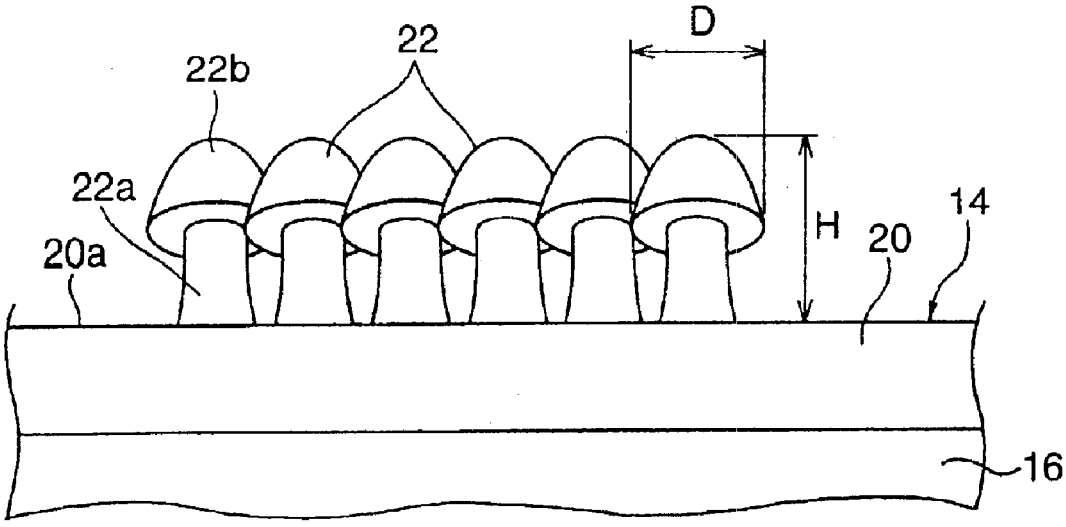
FIG. 2 is an enlarged view of an elastomeric layer in the sheet feed apparatus in FIG. 1.
Figure 3A:
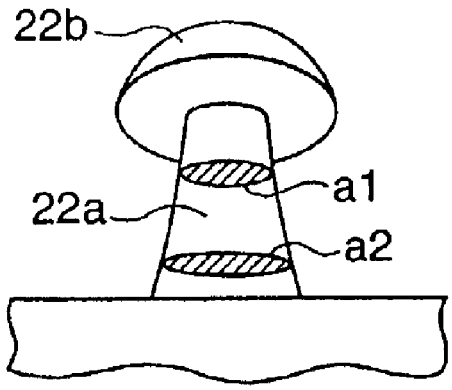
FIG. 3(*a*) shows a modification of a micro-structured element, FIG. 3(*b*) shows another modification of a micro-structured element, and FIG. 3(*c*) shows a further modification of a micro-structured element.
Figure 3B:
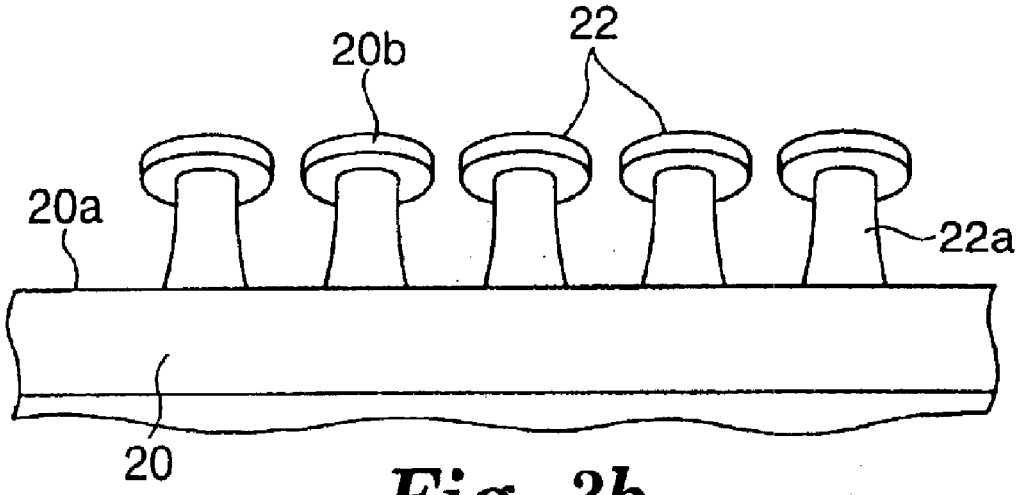
Figure 3C:
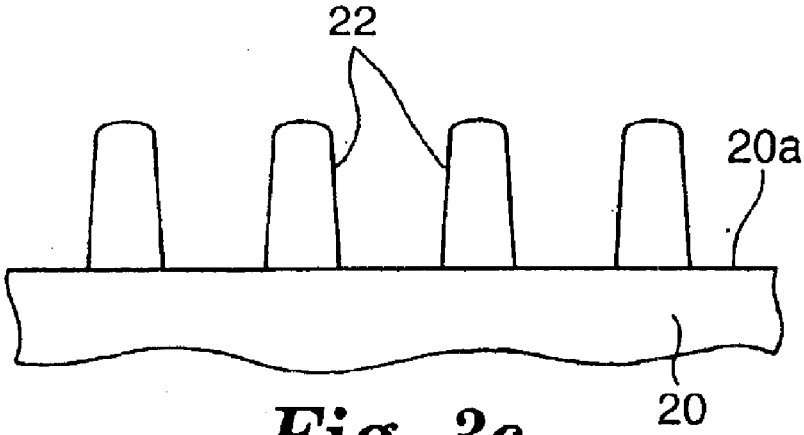

The elastomeric layer 14 includes a base 20 and a plurality of micro-structured elements 22 formed on a surface 20*a* of the base 20, each micro-structured element having a three-dimensionally projecting shape. As shown in FIG. 2 in an enlarged scale, each of the micro-structured elements 22 has a mushroom shape provided with a stem 22*a* standing upright from a surface 20*a* of the base 20 and a head 22*b* formed integral the stem 22*a* to be swollen at a distal end thereof. The stem 22*a* of the respective micro-structured element 22 may have various shapes such as a column or a pyramid. The columnar shape is defined herein as a shape having a generally uniform cross-section in the height or longitudinal direction of the stem 22*a*. The pyramidal shape is defined herein as a shape having a cross-sectional area a1 of the stem 22*a* at a location near the head 22*b* is smaller than a cross-sectional area a2 of the stem 22*a* at a location away from the head 22*b* (i.e., a1<a2), the mutually corresponding peripheral points of these cross sectional areas being connected through a straight or gently curved line. Further, the head 22*b* of the respective micro-structured element 22 may have various shapes, such as a sphere, a hemisphere or a disk (see FIG. 3(*b*)). It should be noted that the micro-structured element may have various shapes other than the illustrated mushroom shape, such as a cylindrical or truncated-conical upright columnar shape with no bulging head (see FIG. 3(*c*)), as disclosed in WO 00/20210.

It is advantageous that the plurality of micro-structured elements 22 are provided on the surface 20*a* of the base 20 in a spatial arrangement density of at least 15.5 stems/cm$^2$, and that the each micro-structured element has a height H of 0.254 mm to 1.27 mm as well as a maximum transverse dimension D of 0.076 mm to 0.76 mm under an aspect ratio $H/D \geqq 1.25$. In one example, the respective micro-structured element 22 has a cylindrical stem 22*a* with a diameter of 250 $\mu$m and a height of 480 $\mu$m and a hemispherical head 22*b* having a diameter (or a maximum transverse dimension) of 300 $\mu$m. In this case, the micro-structured elements 22 are provided on the surface 20*a* of the base 20 in a spatial arrangement density of 465 stems/cm$^2$. Also, a flat lower surface area of the head 22*b* is generally parallel to the surface 20*a* of the base of the elastomeric layer 14 when the stem 22*a* is not bent. One Example of the dimensions and arrangements of the upright-column micro-structured element with no head is similar to those of the micro-structured elements with heads and, in particular, is described in WO 00/20210.

Figure 4:
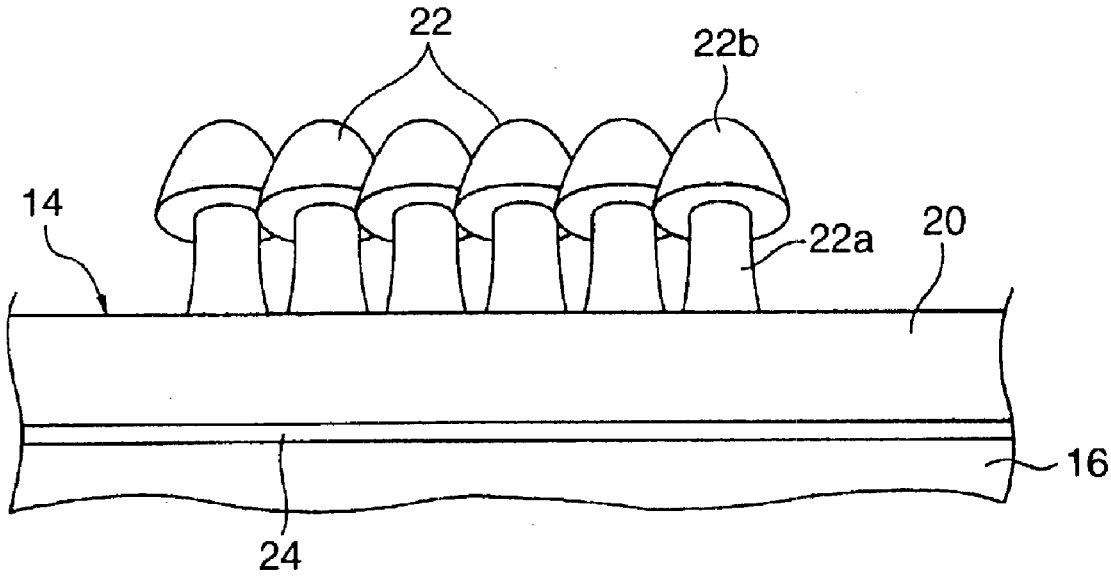
FIG. 4 is an enlarged view of an elastomeric layer in a modification of the sheet feed apparatus in FIG. 1.

The base 20 and the plurality of micro-structured elements 22 of the elastomeric layer 14 may be formed integral with each other of the same elastomeric material. Also, the elastomeric layer 14 may be formed of a seamless hollow cylindrical member made of an elastomeric material. In this case, the elastomeric layer 14 may be secured to the outer circumference 16*a* of the support 16 in the shaft member 12 with the friction and the elastic recovery of the elastic member its own. Or the elastomeric layer 14 may be formed of an elastic member in a plate shape. In such a case, the elastomeric layer 14 may be bonded to the outer circumference 16*a* of the support 16 in the shaft member 12 via an adhesive layer 24 (see FIG. 4). In this regard, an adhesive or a double-coated adhesive tape may be used as the adhesive layer 24.

For example, the base 20 of the elastomeric layer 14 may be formed of a hollow cylindrical member or a plate member having a thickness of 0.2 mm and a Shore A hardness of 70 made of the same ether base urethane rubber as that of the plurality of micro-structured elements 22. The support 16 and the shaft section 18 of the shaft member 12 are molded integral with each other from the same plastic material wherein the support 16 is a cylinder having a diameter of 25 mm and an axial length of 30 mm and the shaft section 18 is a cylinder having a diameter of 9 mm. In this regard, material used for the elastomeric layer 14 may be natural rubber, ethylene-propylene rubber (EPM), ethylene-propylene-diene rubber (EPDM), styrene-butadiene rubber (SBR), butyl rubber (IIR), silicone rubber, urethane rubber or others.

Figure 5:
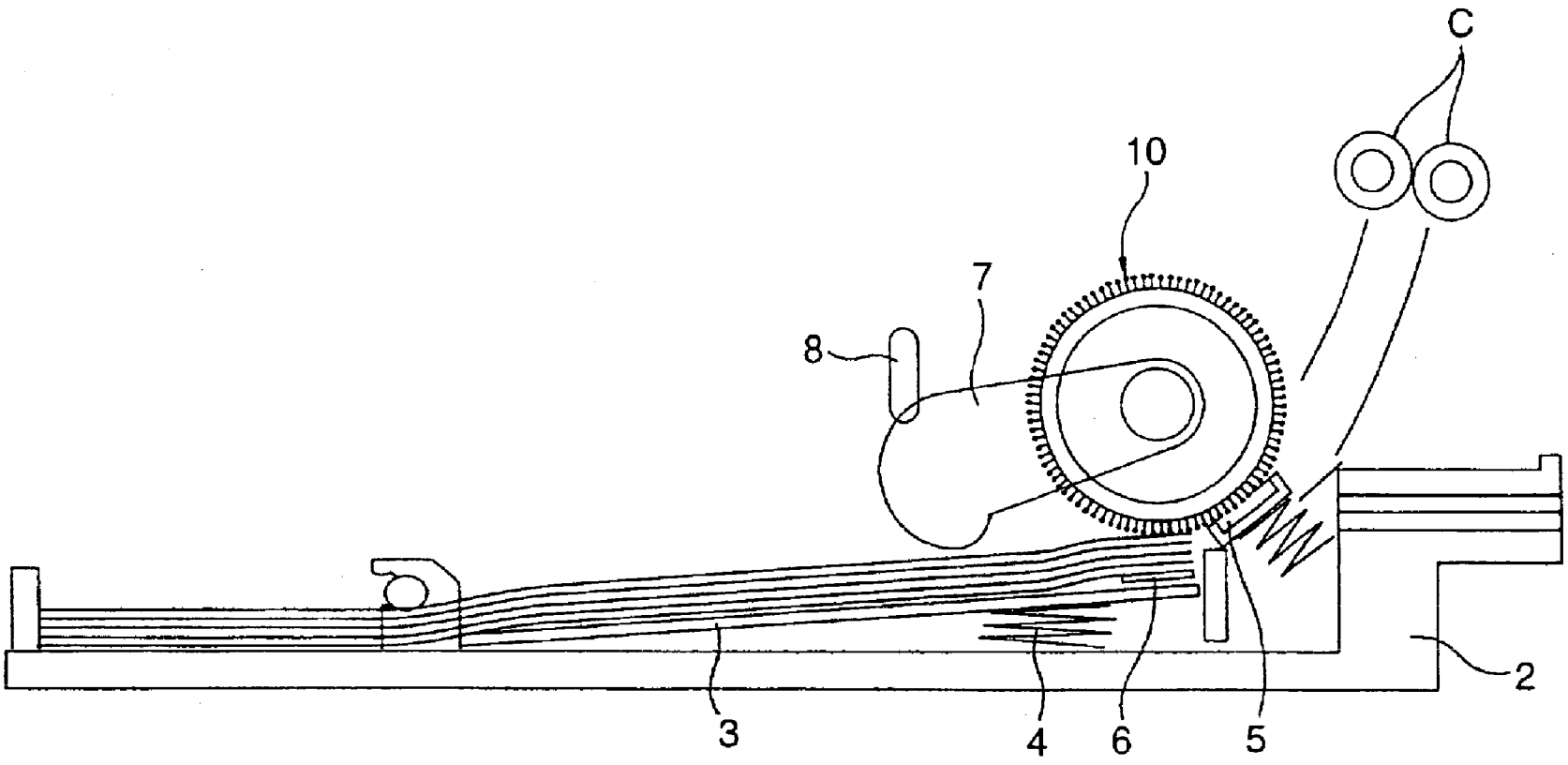
FIG. 5 is a schematic illustration of a sheet feed assembly, according to one embodiment of the present invention, incorporating therein the sheet feed apparatus shown in FIG. 1.
Figure 14A:
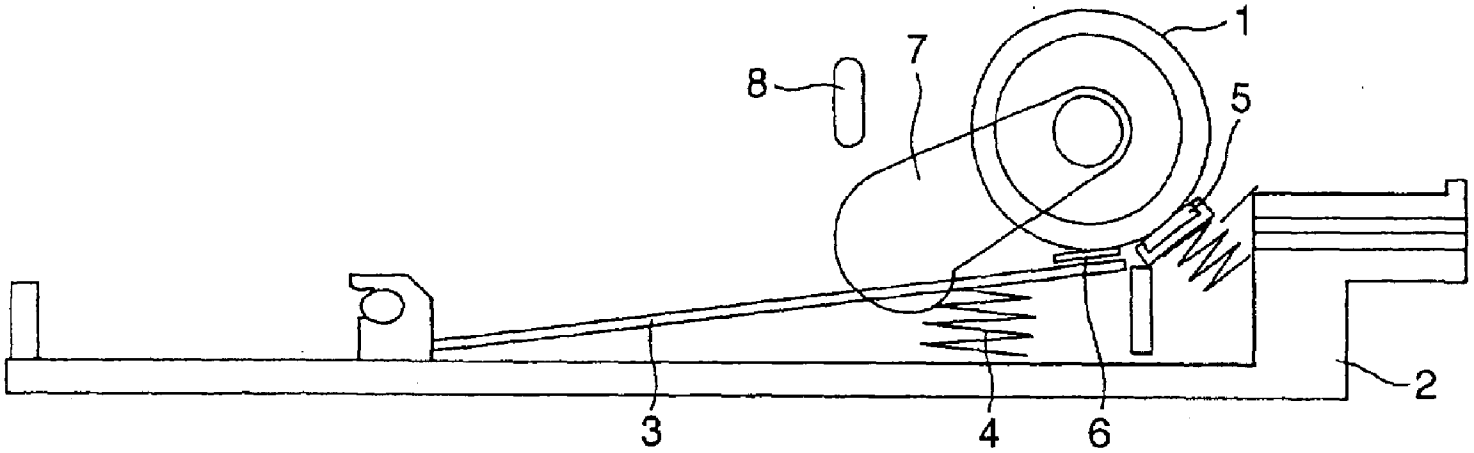
FIG. 14 is a schematic illustration of a prior art sheet feed assembly wherein FIG. 14(*a*) shows a state wherein no sheet media are stocked and FIG. 14(*b*) shows a state wherein sheet media are stocked.

FIG. 5 schematically illustrates a sheet feed assembly, according to one embodiment of the present invention, incorporating therein the above-described sheet feed roller 10. This sheet feed assembly has a structure similar to that in the sheet delivery part of the image-forming apparatus shown in FIG. 14*a* as described, and the explanation will be eliminated about the corresponding constituent elements while denoting them with common reference numerals. The sheet feed assembly includes a sheet feed roller 10, a sheet delivery cassette 2, a sheet support base 3, a presser spring 4, a separating member 5, a final sheet separating plate 6, a sheet detecting arm 7 and a photo-interruptor 8. The sheet feed assembly as shown in FIG. 5 is in a state wherein a plurality of printing sheets are stacked as sheet media on the sheet support base 3 in the sheet delivery cassette 2.

The sheet feeding operation of the sheet feed assembly according to the illustrated embodiment will be described by citing concrete numerical values. For example, the sheet feed roller 10 rotates counter-clockwise in the drawing at a peripheral speed of 120 mm/sec in accordance with image-forming signals issued, for example, from a controller section not shown, picks up one by one the uppermost sheet, pressed onto the sheet feed roller 10, in a group of printing sheets stacked on the sheet support base 3, and conveys the same in the right direction in the drawing. At that time, the uppermost sheet on the sheet support base 3 is pressed onto the sheet feed roller 10 by the presser spring 4 with a force in a range from about 3N to 3.5N. A plurality of micro-structured elements 22 (FIG. 2) on the elastomeric layer 14 provided on the outer circumference of the sheet feed roller 10 are brought into frictional contact at their heads 22*b* with the printing sheet and conveys the latter as the shaft member 12 rotates.

At this stage, if two sheets or more are picked up together from the upper region of the group of printing sheets, the separating member 5 disposed downstream from the nip point between the sheet feed roller 10 and the sheet support base 3 is brought into frictional contact with the lowermost one of the picked-up printing sheets to brake the conveyance of the lowermost sheet. As a result, the printing sheet is ensured to be conveyed one by one. The sheet feed roller 10 rotates until the printing sheet reaches the downstream conveyor roller C, and thereafter is conveyed to a predetermined direction by the conveyor roller C and a mechanism disposed downstream therefrom (not shown).

Figure 6:
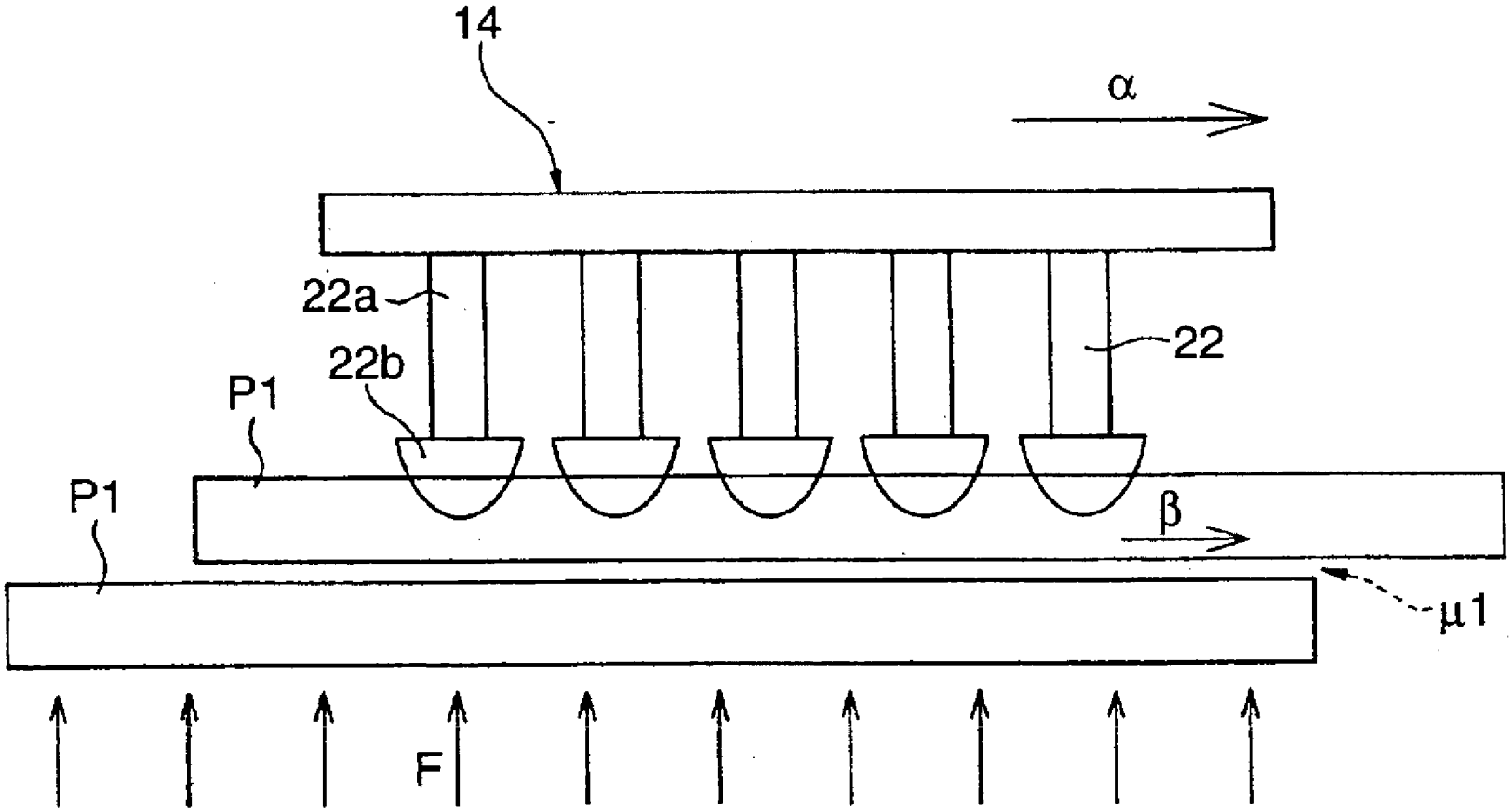
FIG. 6 is a schematic illustration for explaining one sheet feeding operation of the sheet feed apparatus shown in FIG. 1.
Figure 7:
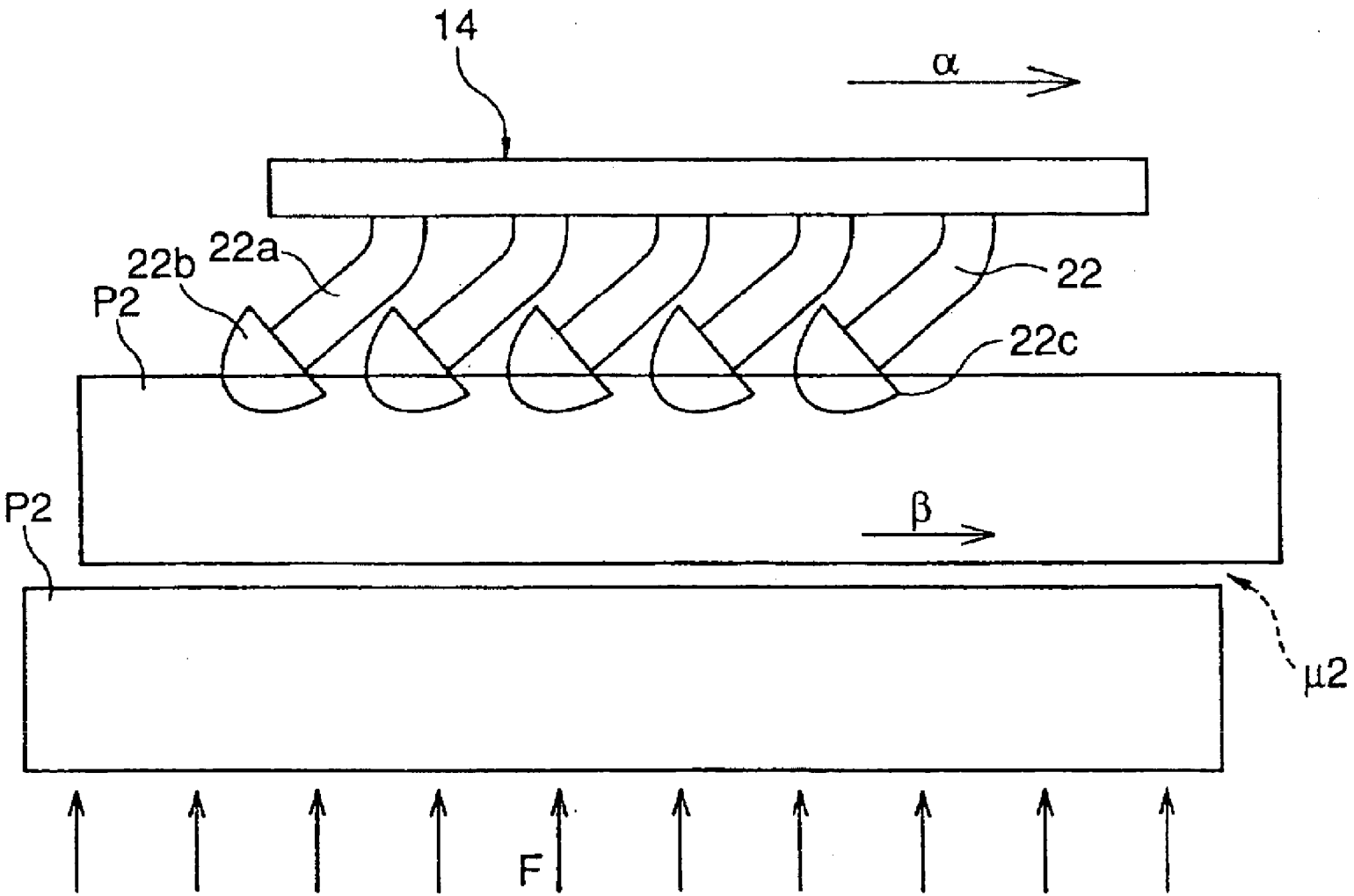
FIG. 7 is a schematic illustration for explaining another sheet feeding operation of the sheet feed apparatus shown in FIG. 1.

FIGS. 6 and 7 illustrate the behavior of the micro-structured element 22 on the sheet feed roller 10 during the sheet feeding operation described above, in relation to the printing sheets (or sheet media) different in thickness. The printing sheet P1 shown in FIG. 6 is a thin paper sheet having a basis weight, for example, of 60 g/m$^2$ and a friction coefficient defined as $\mu$1 between two of them. On the other hand, the printing sheet P2 shown in FIG. 7 is a thick paper sheet having a basis weight, for example, of 200 g/m$^2$ and a friction coefficient defined as $\mu$2 larger than $\mu$1 between two of them.

As the sheet feed roller 10 rotates, the plurality of micro-structured elements 22 on the elastomeric layer 14 move in the arrow direction $\alpha$. At this time, the plurality of printing sheets are pressed onto the plurality of micro-structured elements 22 on the elastomeric layer 14 by a spring bias of the presser spring 4 whereby the heads 22*b* of the micro-structured elements 22 are at least partly embedded in interstice between fibers of the printing sheet.

As for the printing sheet P1, a friction coefficient $\mu$1 between the sheets P1 is approximately 0.5 whereby a frictional force between the heads 22*b* of the plurality of micro-structured elements 22 and the printing sheet P1 is sufficiently larger than that between the sheets P1. As a result, all the stems 22*a* of the plurality of micro-structured elements 22 are not substantially deformed whereby the respective head 22*b* is embedded only at a top thereof into interstices between fibers constituting the printing sheet P1 to feed the uppermost printing sheet P1 in the direction indicated by an arrow $\beta(\approx\alpha)$ in a stable manner.

On the contrary, as for the printing sheet P2, a friction coefficient $\mu$2 between the sheets is as large as approximately 0.7 whereby a frictional force between the heads 22*b* of the plurality of micro-structured elements 22 and the printing sheet P2 is not sufficiently but somewhat larger than that between the sheets P2. As a result, all the stems 22*a* of the plurality of micro-structured elements 22 are elastically bent whereby the respective head 22*b* is embedded deeper at the edge portion thereof into interstices between fibers constituting the printing sheet P2. In this state, a sufficient frictional force is ensured between the heads 22*b* of the plurality of micro-structured elements 22 and the printing sheet P2 to feed the uppermost printing sheet P2 in the direction indicated by an arrow $\beta(\approx\alpha)$ in a stable manner.

In the above arrangement, it is possible to ensure an optimum frictional force relative to the printing sheets P1, P2 by variously altering a shape, a dimension and a hardness of the respective micro-structured element in accordance with thickness, kind and physical properties of the printing sheets P1, P2 to be fed. Thus, according to the sheet feed roller 10, it is possible to effectively decrease the occurrence of the above-mentioned multi-feed caused by an excessive delivery pressure to a thin sheet and the generation of the above-mentioned squeak due to lack of delivery force for a thick sheet by suitably adjusting a shape, dimension, hardness or others of the plurality of micro-structured elements 22 formed on the elastomeric layer 14, whereby a favorable feeding performance can be maintained for a long period irrespective of thicknesses (basis weight), kinds (OHT, glossy paper) or physical properties such as a friction coefficient of a printing sheet (a sheet medium). Also, by using a mechanism for properly controlling a friction coefficient by the elastic deformability of the plurality of micro-structured elements 22, it is possible to mitigate a severe degree of control accuracy adopted in the prior art, for example, in the grip pressure and the feeding speed when the sheet is fed and the physical properties of the feed roller and the separating member.

Figure 8A:
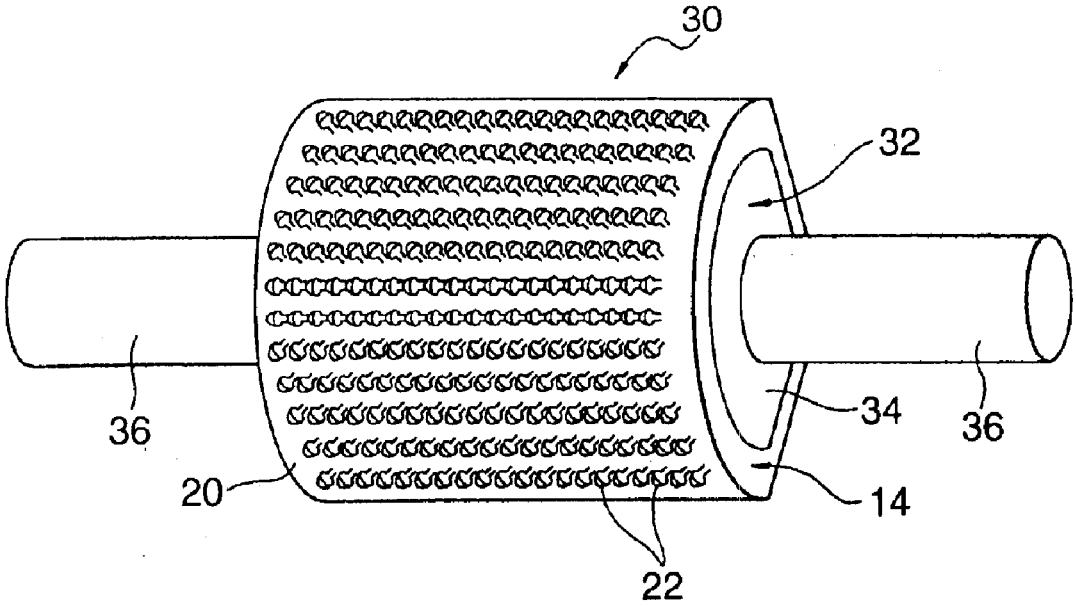
FIG. 8 is an illustration of a second embodiment of a sheet feed apparatus according to the present invention wherein FIG. 8(*a*) is a perspective view and FIG. 8(*b*) is an axial end view.
Figure 8B:
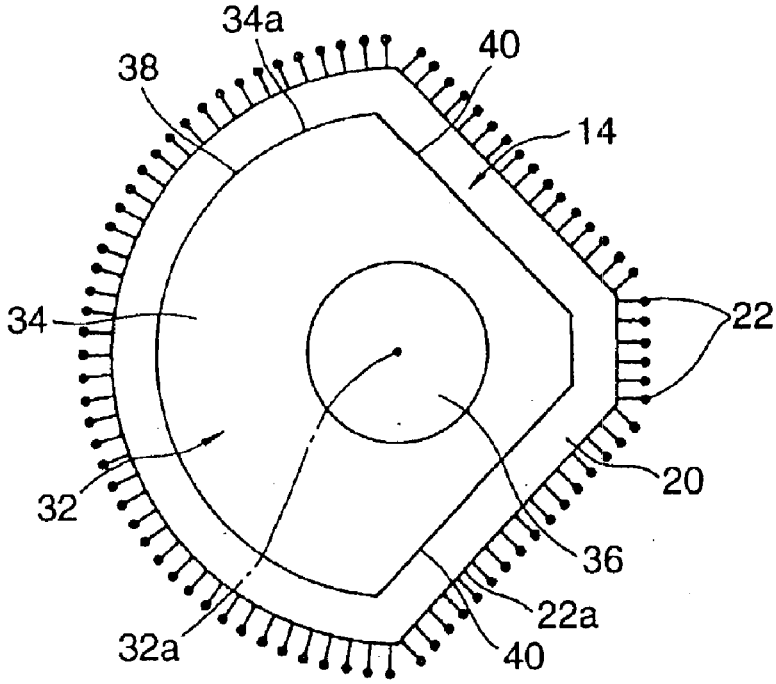

FIG. 8 illustrates a sheet feed apparatus 30 according to a second embodiment of the present invention. Since the sheet feed apparatus 30 has substantially the same structure as that of the sheet feed roller 10 as described, except for the configuration of a shaft member, common reference numerals will be used for denoting the corresponding constituent elements and the explanation thereof will be eliminated. The sheet feed apparatus 30 (hereinafter referred to as a sheet feed roller 30) includes a non-cylindrical support body or shaft member 32 and an elastomeric layer 14 provided on the outer circumference of the shaft member 32. The shaft member 32 has a tubular support 34 having a non-circular cross-sectional outer circumference 34*a* and a pair of shaft sections 36 integral with the support and extending from opposite axial ends of the support 34 in the axial direction to define a rotary axis of the shaft member 32. The elastomeric layer 14 is formed of an elastomeric material separate from the shaft member 32, and attached to the outer circumference 34*a* to be conformed with the profile of the support 34 of the shaft member 32.

The shaft member 32 has a main area 38 arcuately extending in an optional angular range about the rotary axis 32*a*, and a plurality of generally flat auxiliary areas 40 extending within a space encircled by an imaginary cylindrical surface containing the main area 38, and connected to each other and to the main area 38. An elastic member for forming the elastomeric layer 14 is attached to all over the outer circumference 34*a* of the shaft member 32 including the main area 38 and the plurality of auxiliary areas 40. The elastic member is provided with a plurality of micro-structured elements 22 at least in a region corresponding to the main area 38.

In a preferred embodiment, the support 34 and the shaft sections 36 of the shaft member 32 are molded together as a single piece with the same plastic material. The support 34 has a composite shape in combination of a semi-cylinder having a diameter of 25 mm, an axial length of 30 mm and a center angle of 170 degrees with a quadrangular column having an equilateral trapezoidal cross-section having a bottom side of 25 mm long. The shaft section 36 is of a cylinder having a diameter of 9 mm. In this arrangement, the elastic member forming the elastomeric layer 14 is preferably a cylindrical member capable of being in tight contact with the outer circumference 34*a* of the support of the shaft member 32 by the elastic recovery of its own. Or, if the elastomeric layer 14 is formed of a plate member, opposite ends of the elastomeric layer 14 are preferably disposed at a position corresponding to the auxiliary area 40 of the support 34 in the shaft member 32.

Figure 9:
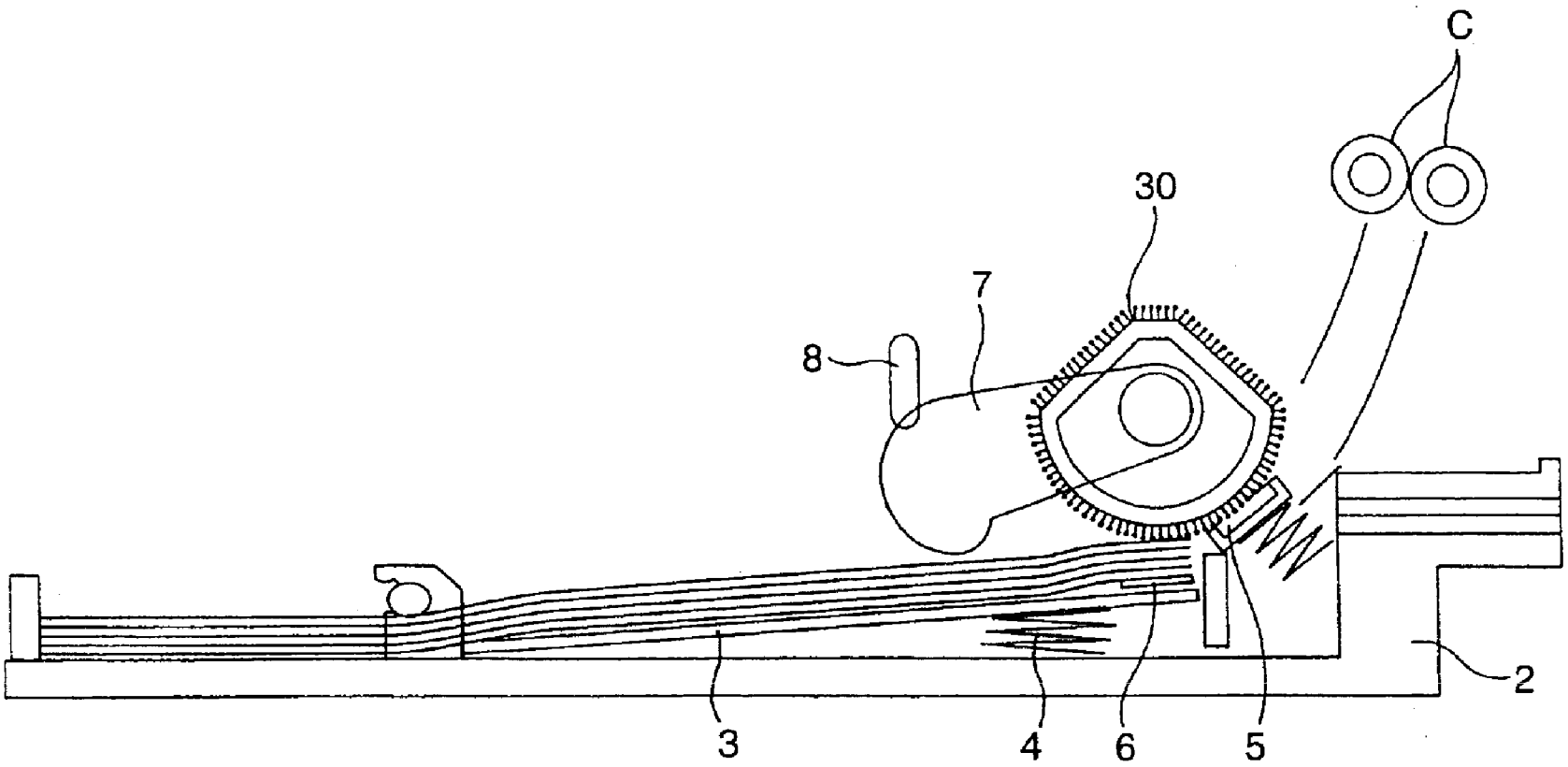
FIG. 9, is a schematic illustration of a sheet feed assembly, according to another embodiment of the present invention, incorporating therein the sheet feed apparatus shown in FIG. 8.

FIG. 9 schematically illustrates a configuration of a sheet feed assembly, according to another embodiment of the present invention, incorporating therein the above-described sheet feed roller 30. Since this sheet feed assembly has the same structure as the sheet feed assembly shown in FIG. 5 as described, common reference numerals will be used for denoting the corresponding constituent elements and the explanation thereof will be eliminated. The sheet feed assembly includes a sheet feed roller 30, a sheet delivery cassette 2, a sheet support base 3, a presser spring 4, a separating member 5, a final sheet separating plate 6, a sheet detecting arm 7 and a photo-interruptor 8. The sheet feed assembly shown in FIG. 9 is in a state wherein a plurality of printing sheets are stacked as sheet media on the sheet support base 3 in the sheet delivery cassette 2.

The sheet feeding operation of the sheet feed assembly according to the illustrated embodiment will be described by citing concrete numerical values. According to this arrangement, in the waiting time when the feeding of printing sheet is interrupted, the sheet feed roller 30 occupies a rotational position at which a polygonal area of the elastomeric layer 14 (corresponding to the plurality of auxiliary areas 34*a* on the outer circumference 34*a* of the support) confronts the group of printing sheets on the sheet support base 3. The sheet feed roller 10 rotates once from this waiting position counterclockwise in the drawing at a peripheral speed of 120 mm/sec in accordance with image-forming signals issued, for example, from a controller section not shown, picks up one by one the uppermost sheet and then stops. In the meantime, at a predetermined rotational position, the group of printing sheets on the sheet support base 3 is pressed onto a cylindrical area of the elastomeric layer 14 provided on the outer circumference of the sheet feed roller 30 (corresponding to the main area 38 on the outer circumference 34*a* of the support) by the bias of the presser spring 4. Then, in a similar manner as described with reference to FIGS. 5 to 7, the uppermost sheet in the group of printing sheets pressed onto the sheet feed roller 30 is picked up and fed in the right direction in the drawing.

Preferably, at least a front end of the printing sheet picked up from the sheet support base 3 reaches the conveyor roller C by the one rotation of the sheet feed roller 30. Thereafter, the printing sheet is conveyed by the conveyor roller C and a mechanism disposed downstream therefrom (not shown) in a predetermined direction. The sheet feed roller 30 is maintained at a stop position until a rear end of the fed printing sheet passes the separating member 5. When a plurality of printing sheets are consecutively fed, the sheet feed roller 30 rotates once more after the rear end of the printing sheet has passed the separating member 5.

According to the above arrangement, since the elastomeric layer 14 of the sheet feed roller 30 is brought into contact with the printing sheet solely by the cylindrical area thereof (the area corresponding to the main area 38 on the outer circumference 34*a* of the support), there is an advantage in that a stress to be imparted to the surface of the printing sheet is minimized as well as a torque of the sheet feed roller 30 is reduced.

In this regard, the sheet feed rollers 10, 30 of the above structure should not be limited to the application to the sheet delivery roller in the sheet delivery part in the illustrated embodiments, but may be also applied to a conveyor roller in a sheet conveyor mechanism.

Figure 10A:
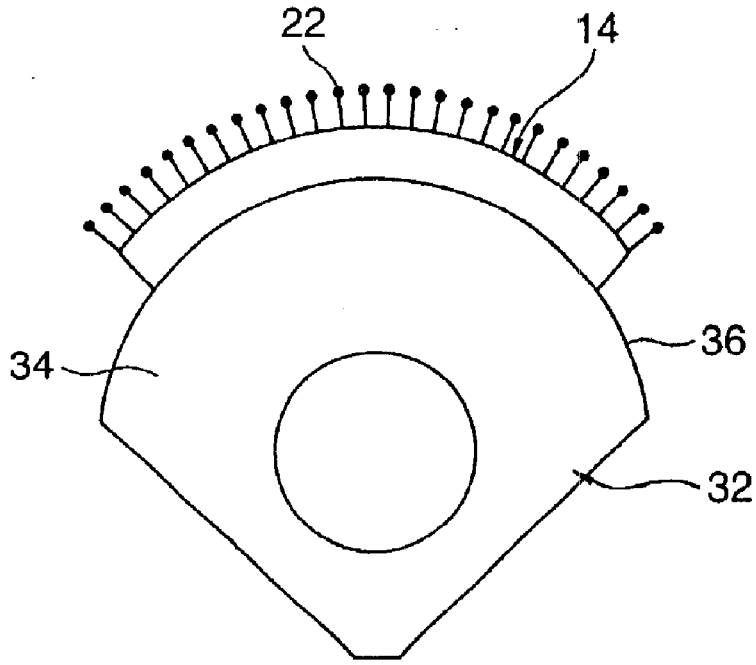
FIG. 10(*a*) shows a modification of a sheet feed roller, and FIG. 10(*b*) shows another modification of a sheet feed roller.
Figure 10B:
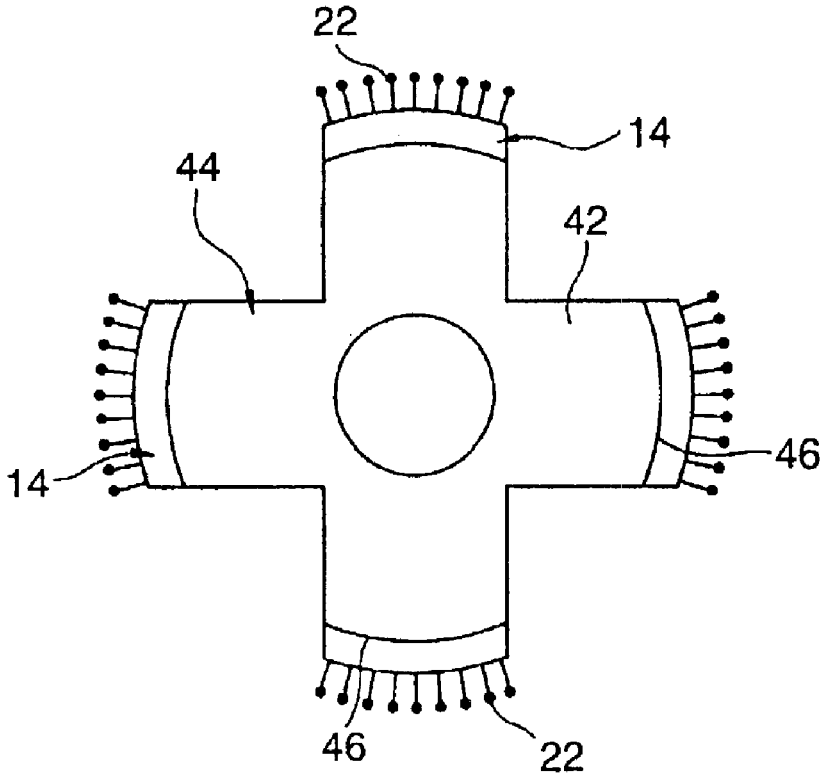

When the shaft member 32 provided with the support 34 having the above-mentioned non-circular outer circumference 34*a* is used for the sheet feed roller, it is possible to secure the elastomeric layer 14 formed of a plate-like member solely in the main area 38 via the adhesive layer 24 (FIG. 4) as shown in FIG. 10(*a*). Also as shown in FIG. 10(*b*), the elastomeric layer 14 formed of a plate-like member may be secured to each of a plurality of main areas 46 in a non-circular support 42 of a non-cylindrical shaft member 44. In either of the sheet feed rollers, the sheet feeding performance can be exhibited in the area of the elastomeric layer 14 having a plurality of micro-structured elements 22.

It should be noted that the sheet feed apparatus according to the present invention may also have a configuration of an endless-belt-like member performing a feeding motion in a predetermined direction, other than the configuration of the feed roller as in the illustrated embodiments. In this arrangement, the endless-belt-like member is constructed to include an elastomeric layer performing a sheet feeding motion and a plurality of micro-structured elements, having above-described structure, formed in the elastomeric layer.

Figure 11:
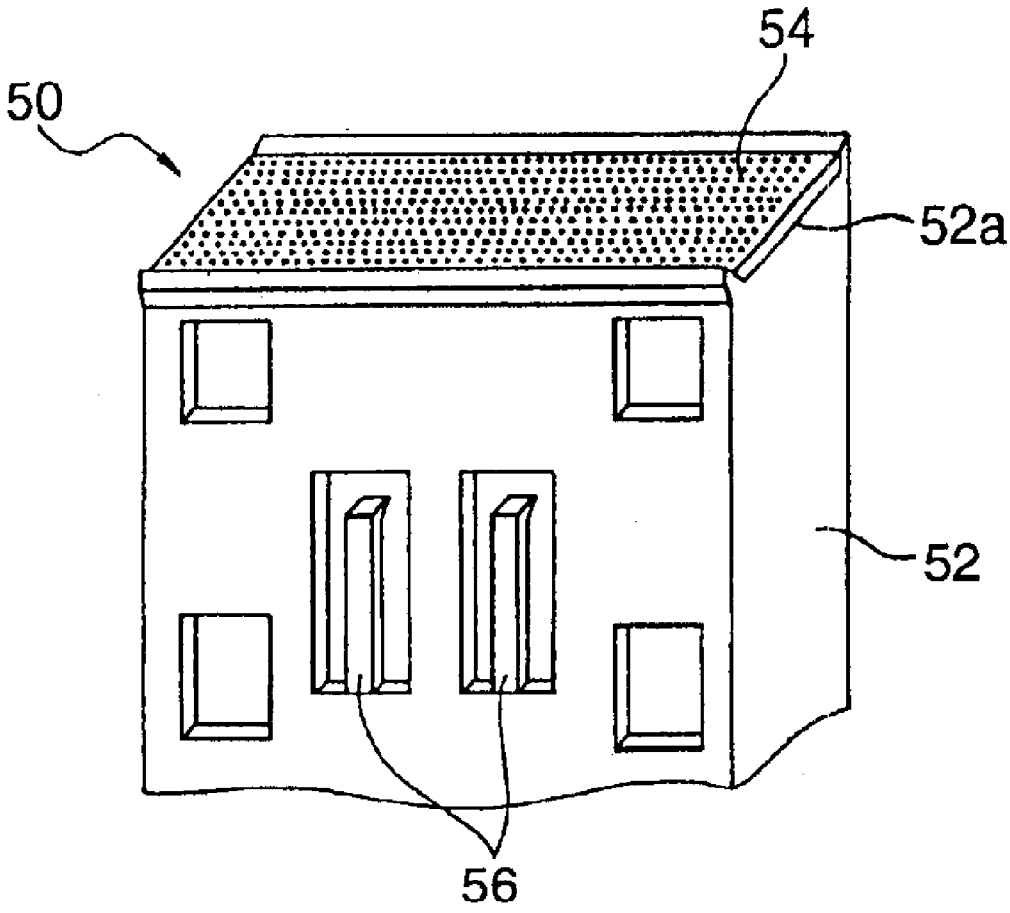
FIG. 11 is a schematic perspective view of a sheet separating member according to one embodiment of the present invention.
Figure 15:
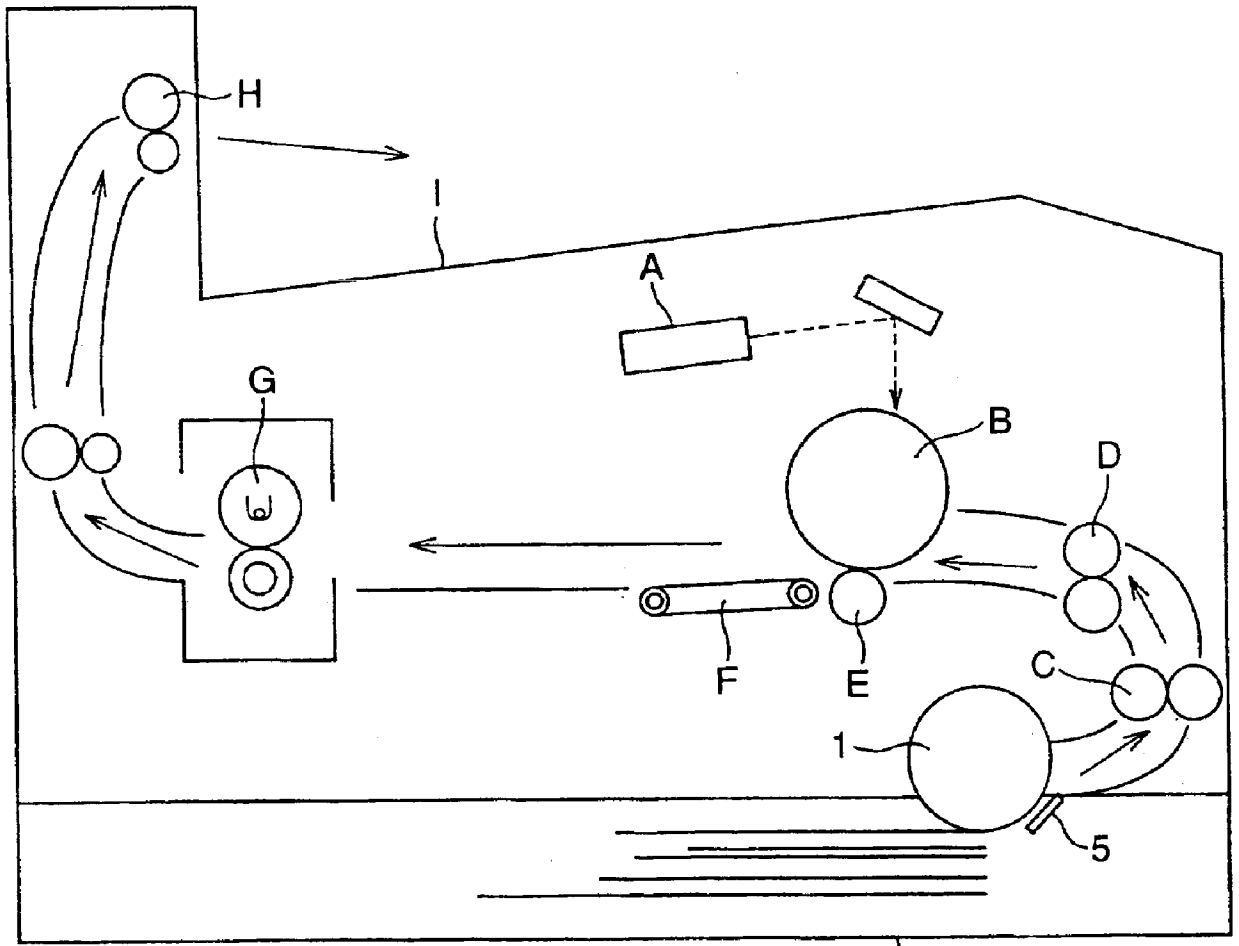
FIG. 15 is a schematic illustration of a prior art image-forming apparatus provided with the sheet feed assembly shown in FIG. 13.

FIG. 11 shows one embodiment of a sheet separating member 50 according to the present invention. The sheet separating member 50 includes a support body 52 and a elastomeric layer 54 provided on a generally flat surface 52*a* of the support 42. The support body 52 has, integral therewith, lugs 56 for the attachment to the image-forming apparatus, for example, shown in FIG. 15 and a spring holder not shown for holding a presser spring. The elastomeric layer 54 is formed of an elastic member separate from the support body 52, and secured to the surface 52*a* of the support 52 body, for example, via an adhesive layer.

Figure 12:
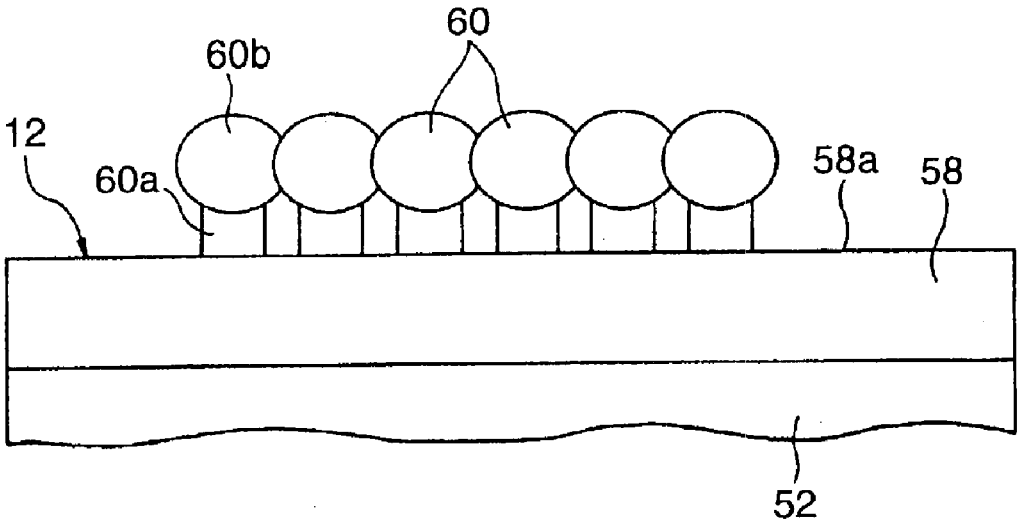
FIG. 12 is an enlarged view of an elastomeric layer in the sheet separating member in FIG. 11.

The elastomeric layer 54 includes a base 58 and a plurality of micro-structured elements 60, each having a three-dimensionally projected shape. As shown in FIG. 12 in an enlarged scale, each of the micro-structured elements 60 has a mushroom shape provided with a stem 60*a* standing upright from a surface 58*a* of the base 58 and a head 60*b* formed integral the stem 60*a* to be swollen at a distal end thereof. The stem 60*a* of the respective micro-structured element 60 may have various shapes such as a column or a pyramid. The head 60*b* of the respective micro-structured element 60 may have various shapes such as a sphere, a hemisphere or a disk. It should be noted that the micro-structured element may have various shapes other than the illustrated mushroom shape, such as an upright column shape with no bulging head as disclosed in WO 00/20210.

It is advantageous that the plurality of micro-structured elements 60 are provided on the surface 58*a* of the base 58 in a spatial arrangement density of at least 15.5 stems/cm$^2$, and that the each micro-structured element 60 has a height H of 0.254 mm to 1.27 mm as well as a maximum transverse dimension D of 0.076 mm to 0.76 mm under an aspect ratio $H/D \geqq 1.25$. In one example, the respective micro-structured element 60 has a cylindrical stem 60*a* with a diameter of 250 $\mu$m and a height of 480 $\mu$m and a spherical head 60*b* having a diameter (or a maximum transverse dimension) of 300 $\mu$m. In this case, the micro-structured elements 60 are provided on the surface 58*a* of the base 58 in a spatial arrangement density of 465 stems/cm$^2$. One Example of the dimensions and arrangements of the upright-column micro-structured element with no head is similar to those of the micro-structured elements with heads and, in particular, is described in WO 00/20210.

The base 58 and the plurality of micro-structured elements 60 of the elastomeric layer 54 may be formed integral with each other of the same elastomeric material. For example, the base 58 of the elastomeric layer 54 may be formed of a plate-like member having a thickness of 2 mm and a Shore hardness of 40, made of the same ether type urethane rubber as that of the plurality of micro-structured elements 60. The support body 52 is molded as a one-piece body as a whole from a plastic material. In this regard, material used for the elastomeric layer 54 may be natural rubber, ethylene-propylene rubber (EPM), ethylene-propylene-diene rubber (EPDM), styrene-butadiene rubber (SBR), butyl rubber (IIR), silicone rubber, urethane rubber or others.

Figure 13:
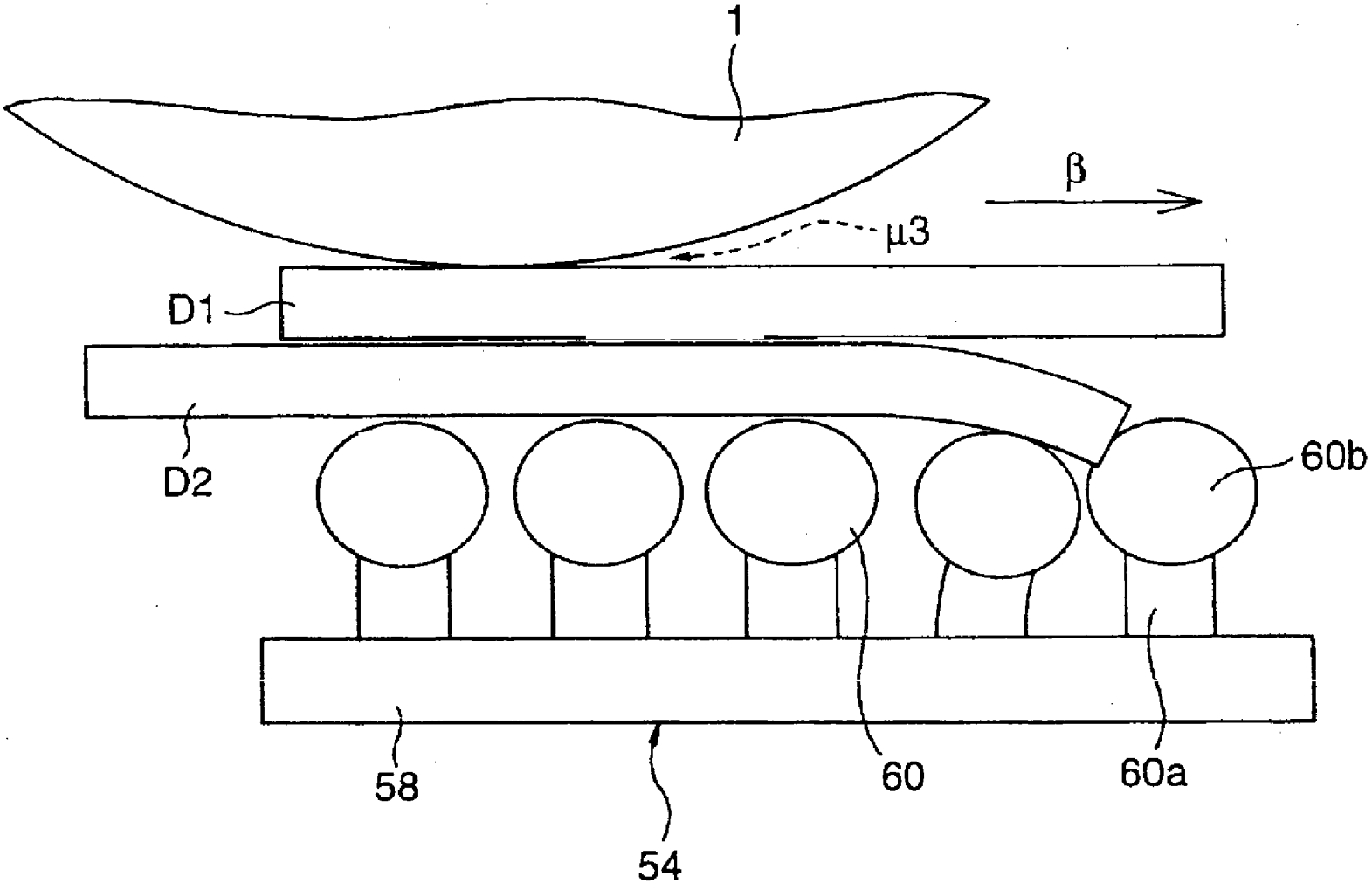
FIG. 13, is a schematic illustration for explaining the separating operation of the sheet separating member shown in FIG. 11.
Figure 14B:
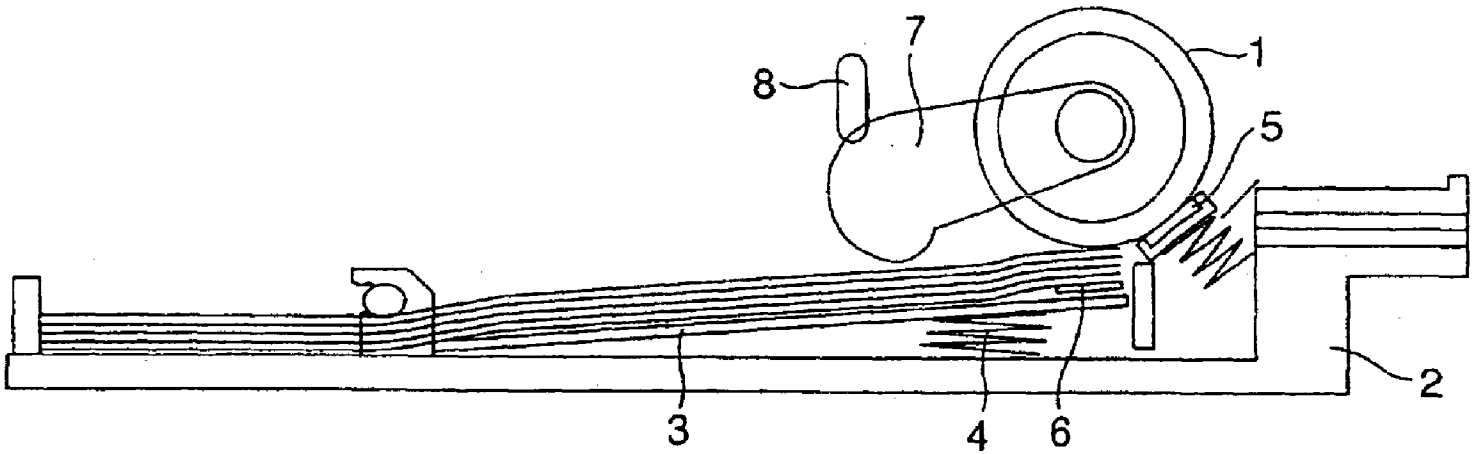

The sheet separating operation when the sheet separating member 50 according to the above embodiment is used instead of the separating member 5 in the sheet feed assembly as shown in FIG. 14 will be described with reference to FIG. 13. When the uppermost two printing sheets (or sheet media) D1, D2 are picked up together from a group of printing sheets by the sheet feed roller 1, the upper sheet D1 is fed in the direction indicated by an arrow $\beta$ by a force in correspondence to a friction coefficient $\mu$3 between the sheet and the outer circumference of the sheet feed roller. On the other hand, the lower sheet D2 is held on the separating member 50 by a force in correspondence to a friction coefficient $\mu$4 between the sheet and the heads 60*b* of the plurality of micro-structured elements 60 provided on the elastomeric layer 54 of the sheet separating member 50.

If a friction coefficient between the printing sheets D1 and D2 is larger than $\mu$4, the lower printing sheet D2 is liable to move along with the upper one D1 in the direction indicated by an arrow $\beta$. At this time, a front end of the printing sheet D2 impinges some of the heads 60*b* of the micro-structured elements 60 as illustrated. Thereby, a resist force is applied to the printing sheet D2 by the micro-structured elements 60 against the movement thereof in the sheet feeding direction to hold the same on the sheet separating member 50. In this regard, when the head 60*b* of the micro-structured element 60 is provided with a smoothly-shaped outer surface, the resist force applied to the front end of the printing sheet is reduced, which may prevent a so-called "sheet-end fold" phenomenon in which the front end portion of the printing sheet is turned up or down, and may also prevent paper powder from sticking to the micro-structured element 60. Accordingly, it is advantageous that the head 60*b* of the micro-structured element 60 has a smoothly-shaped outer surface, such as a spherical or hemispherical shape.

According to the sheet separating member 50 of the above-mentioned structure, based on the same principle as described regarding the sheet feed roller 10, 30, it is possible to maintain a favorable sheet separating performance for a long period irrespective of a thickness (basis weight) or kind (OHT or glossy paper) of the printing sheet to be fed.

The above-mentioned sheet separating member 50 may be used in combination with the sheet feed roller 10, 30 described above. The sheet feeding device according to the present invention thus structured is characterized in either cases in that the following relationship is satisfied:

$$\mu a > \mu b > \mu c$$

wherein $\mu a$ is a friction coefficient between the frictional feeding surface of the sheet feed roller and the sheet medium, $\mu b$ is a friction coefficient between the frictional braking surface of the sheet separating member and the sheet medium, and $\mu c$ is a friction coefficient between the sheet medium.

As is apparent from the above description, according to the present invention, there are provided a sheet feed apparatus as well as a sheet feed assembly, capable of maintaining a favorable sheet feeding performance for a long period irrespective of a thickness (or a basis weight) of a sheet material or a type of the sheet material (an OHT or a glossy paper). Also, there are provided a sheet separating member as well as a sheet separating assembly, capable of maintaining a favorable sheet separating performance for a long period irrespective of a thickness (or a basis weight) of a sheet material or a type of the sheet material (an OHT or a glossy paper).

What is claimed is:

1. A sheet feed apparatus with an elastomeric layer formed on a surface of a non-cylindrical support body which is rotatable about a rotary axis, characterized in that:

said surface of said support body includes a main area arcuately extending over a desired center angle about said rotary axis and at least one auxiliary area extending inside an imaginary cylindrical surface containing said main area to be joined to said main area;

said elastomeric layer comprises a base and a plurality of micro-structured elements formed on a surface of said base, each micro-structured element having a three-dimensionally projecting shape and being formed integrally with said base with a mutually identical elastic material; and that each micro-structured element is adapted to come into frictional contact at a distal end thereof with a sheet material to feed the sheet material by a rotation of said support body about said rotary axis.

2. A sheet feed apparatus as defined by claim 1, wherein said plurality of micro-structured elements are provided on said surface of said support body in a spatial arrangement density of at least 15.5 stems/cm$^2$; and wherein said each micro-structured element has a height H of 0.254 mm to 1.27 mm as well as a maximum transverse dimension D of 0.076 mm to 0.76 mm under an aspect ration $H/D \geqq 1.25$.

3. A sheet feed apparatus as defined by claim 1, wherein each micro-structured element includes a columnar or pyramidal stem and a spherical, hemispherical or disk-like head integrally formed at a distal end of said stem.

4. A sheet feed apparatus as defined by claim 1, wherein said support body includes a tubular support having an outer circumference defining said surface of said support body and a shaft section extending axially from said tubular support to define said rotary axis; and wherein said elastomeric layer is formed of an elastic member fitted to said outer circumference of said tubular support in such a manner as to conform with a profile of said outer circumference.

5. A sheet feed apparatus as defined by claim 4, wherein said elastic member is provided with said plurality of micro-structured elements at least at a position corresponding to said main area of said surface of said support body.

6. A sheet feed apparatus as defined by claim 4, wherein said elastic member is of a plate-like member adhered to said outer circumference of said tubular support through an adhesive layer; and wherein a marginal edge of said elastic member is located at a position corresponding to said at least one auxiliary area of said surface of said support body.

7. A sheet feed apparatus as defined by claim 4, wherein said elastic member is of a seamless hollow cylindrical member fixedly attached to said outer circumference of said tubular support by a friction force and an elastic recovery force of said elastic member.

8. A sheet separating assembly comprising a sheet feed roller with an elastomeric layer formed on an outer circumference of a shaft member, and a sheet separating member, characterized in that:

said sheet separating member has an elastomeric layer formed on a surface of a supporting body;

each of said elastomeric layer of said sheet feed roller and said elastomeric layer of said sheet separating member comprises a base and a plurality of micro-structured elements formed on a surface of said base, each micro-structured element having a three-dimensionally projecting shape and being formed integrally with said base with a mutually identical elastic material;

each micro-structured element of said elastomeric layer on said outer circumference of said shaft member is adapted to come into frictional contact at a distal end thereof with a sheet material to feed the sheet material in a desired direction by a rotation of said shaft member; and that each micro-structured element of said elastomeric layer on said surface of said supporting body is adapted to come into frictional contact at a distal end thereof with a sheet material moving in the desired direction to brake the movement of the sheet material.

9. A sheet separating member with an elastomeric layer formed on a surface of a supporting body, characterized in that:

said elastomeric layer comprises a base and a plurality of micro-structured elements formed on a surface of said base, each micro-structured element having a three-dimensionally projecting shape and being formed integrally with said base with a mutually identical elastic material; and that each micro-structured element is adapted to come into frictional contact at a distal end thereof with a sheet material moving in a desired direction relative to said elastomeric layer to brake the sheet material.

10. A sheet feed assembly comprising a sheet support base, a sheet feed apparatus for feeding a plurality of sheet materials stacked on said sheet support base, and a sheet separating member for cooperating with said sheet feed apparatus to feed the sheet materials in a one-by-one separated manner, characterized in that:

said sheet separating member comprises a sheet separating member as defined by claim 9.

11. A sheet separating member as defined by claim 9, wherein said plurality of micro-structured elements are provided on said surface of said base in a spatial arrangement density of at least 15.5 stems/cm$^2$, and wherein said each micro-structured element has a height H of 0.254 mm to 1.27 mm as well as a maximum transverse dimension D of 0.076 mm to 0.76 mm under an aspect ratio $H/D \geqq 1.25$.

12. A sheet separating member as defined by claim 9, wherein each micro-structured element includes a columnar or pyramidal stem and a spherical, hemispherical or disk-like head integrally formed at a distal end of said stem.

13. A sheet separating member as defined by claim 9, wherein each micro-structured element has a cylindrical or truncated-conical shape.

14. A sheet feed apparatus adapted to cooperate with a sheet separating member to feed a plurality of sheet materials in a one-by-one separated manner, characterized in that:

said apparatus comprises an elastomeric layer performing a sheet feeding motion;

said elastomeric layer comprises a base and a plurality of micro-structured elements formed on a surface of said base, each micro-structured element having a three-dimensionally projecting shape and being formed integrally with said base with a mutually identical elastic material; and that each micro-structured element is adapted to come into frictional contact at a distal end thereof with a sheet material to feed the sheet material by said sheet feeding motion.

15. A sheet feed apparatus as defined by claim 14, wherein said plurality of micro-structured elements are provided on said surface of said base in a spatial arrangement density of at least 15.5 stems/$cm^2$; and wherein said each micro-structured element has a height H of 0.254 mm to 1.27 mm as well as a maximum transverse dimension D of 0.076 mm to 0.76 mm under an aspect ratio $H/D \geqq 1.25$.

16. A sheet feed apparatus as defined by claim 14, wherein each micro-structured element has a cylindrical or truncated-conical shape.

17. A sheet feed apparatus as defined by claim 14, wherein each micro-structured element includes a columnar or pyramidal stem and a spherical, hemispherical or disk-like head integrally formed at a distal end of said stem.

18. A sheet feed apparatus as defined by claim 14, further comprising a shaft member rotatable about a rotary axis, said elastomeric layer being formed on an outer circumference of said shaft member; wherein said shaft member includes a tubular support having said outer circumference and a shaft section extending axially from said tubular support to define said rotary axis; and wherein said elastomeric layer is formed of an elastic member fitted to said outer circumference of said tubular support in such a manner as to conform with a profile of said outer circumference.

19. A sheet feed apparatus as defined by claim 18, wherein said outer circumference of said tubular support includes a main area arcuately extending over a desired center angle about said rotary axis and at least one auxiliary area extending inside an imaginary cylindrical surface containing said main area to be joined to said main area; and wherein said elastic member is provided with said plurality of micro-structured elements at least at a position corresponding to said main area of said outer circumference of said tubular support.

20. A sheet feed apparatus as defined by claim 19, wherein said elastic member is of a plate-like member adhered to said outer circumference of said tubular support through an adhesive layer; and wherein a marginal edge of said elastic member is located at a position corresponding to said at least one auxiliary area of said outer circumference.

21. A sheet feed apparatus as defined by claim 18, wherein said elastic member is of a seamless hollow cylindrical member fixedly attached to said outer circumference of said tubular support by a friction force and an elastic recovery force of said elastic member.

22. A sheet feed assembly comprising a sheet support base and a sheet feed apparatus for feeding a plurality of sheet materials stacked on said sheet support base, characterized in that:

said sheet feed apparatus comprises a sheet feed apparatus as defined by claim 14.

* * * * *

UNITED STATES PATENT AND TRADEMARK OFFICE

CERTIFICATE OF CORRECTION

PATENT NO. : 6,874,777 B2
APPLICATION NO. : 10/397113
DATED : April 5, 2005
INVENTOR(S) : Koichi Sano It is certified that error appears in the above-identified patent and that said Letters Patent is hereby corrected as shown below:

Cover Page

Column 1, under "U.S. PATENT DOCUMENTS", the following references should be added:

| | | |
|---|---|---|
| --6,145,831 | 11/2000 | Inoue et al. |
| 4,889,271 | 12/1989 | Kurokawa |
| 2,755,086 | 07/1956 | Lubersky |
| 1,457,158 | 05/1923 | Gammeter-- |

Column 2, under "FOREIGN PATENT DOCUMENTS", the following references should be added:

| | |
|---|---|
| --UK 2,223,452 | 04/1990 |
| WO 00/20210 | 04/2000 |
| JP 2002 002988 | 01/2002 |
| JP 07 137901 | 05/1995 |
| JP 06 239483 | 08/1994-- |

Signed and Sealed this

Fifth Day of February, 2008

JON W. DUDAS
*Director of the United States Patent and Trademark Office*